United States Patent [19]

Sankar

[11] 4,412,495

[45] Nov. 1, 1983

[54] TOTAL BODY PROTECTIVE SHIELD

[76] Inventor: Wilfred A. Sankar, 3209 Snyder Ave., Apt. 10, Brooklyn, N.Y. 11226

[21] Appl. No.: 261,603

[22] Filed: May 7, 1981

[51] Int. Cl.[3] ..... F41H 5/06

[52] U.S. Cl. ..... 109/49.5; 2/2.5; 109/58.5; 89/36 D

[58] Field of Search ..... 109/49.5, 58.5; 2/2.5, 2/255, 259; 224/907; 267/156; 40/586, 604, 610, 617; 89/36 D, 36 F

[56] References Cited

U.S. PATENT DOCUMENTS 1,635,915 7/1927 White ..... 40/617
2,020,702 11/1935 Russell ..... 2/2.5
2,956,795 10/1960 Foster ..... 267/156
3,745,938 7/1973 Hathaway et al. ..... 109/49.5
3,916,838 11/1975 Swart ..... 40/617

FOREIGN PATENT DOCUMENTS 1027433 4/1966 United Kingdom ..... 40/617

*Primary Examiner*—Robert Peshock
*Assistant Examiner*—David Tarnoff
*Attorney, Agent, or Firm*—Richard L. Miller

[57] ABSTRACT

A Total Body Protective device including a pair of fabric panels made of bullet-proof material, handles on an upper of the panel pieces for holding the device in front of a person, and a window through the top panel piece for observing an assailient, and means to roll up or fold the device when not in use.

1 Claim, 4 Drawing Figures

20
17
10
12
18
11
25
13
28
21
15
16
17
19
18
14
27
26
24
23
22

20
12
21
16
18
14
13
23
22

28
16
15
29
31
18
19
18
28
32
30
31

29
28
29
30

TOTAL BODY PROTECTIVE SHIELD

This invention relates generally to bullet-proof shields.

BACKGROUND OF THE INVENTION

It is well known that with the continued increase in hold up and burglarly crimes, more personal protective devices are needed by the average citizen. Many such crimes occur when a criminal acosts a person in a secluded street or in front of a resident's door, where a person is confronted by a hand gun being pointed at him.

SUMMARY OF THE INVENTION

A principal object of the present invention is to provide a protective shield that can be quickly placed between a person and a criminal, so as to shield the person from any bullet fired at him from a hand-held firearm.

Another object is to provide a protective shield which can be held up in front of a person and shield his entire body from a bullet.

Yet another object is to provide a total Body Protective Shield which when not in use, can be stored in a rolled up condition for placement near a door of a person's residence or which can be carried by a pedestrian out-of-doors similarly to a cane, for instant use whenever needed.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

The figures on the drawings are briefly described as follows.

DETAILED DESCRIPTION OF THE PREFERRED EMBODIMENT

Figure 1:
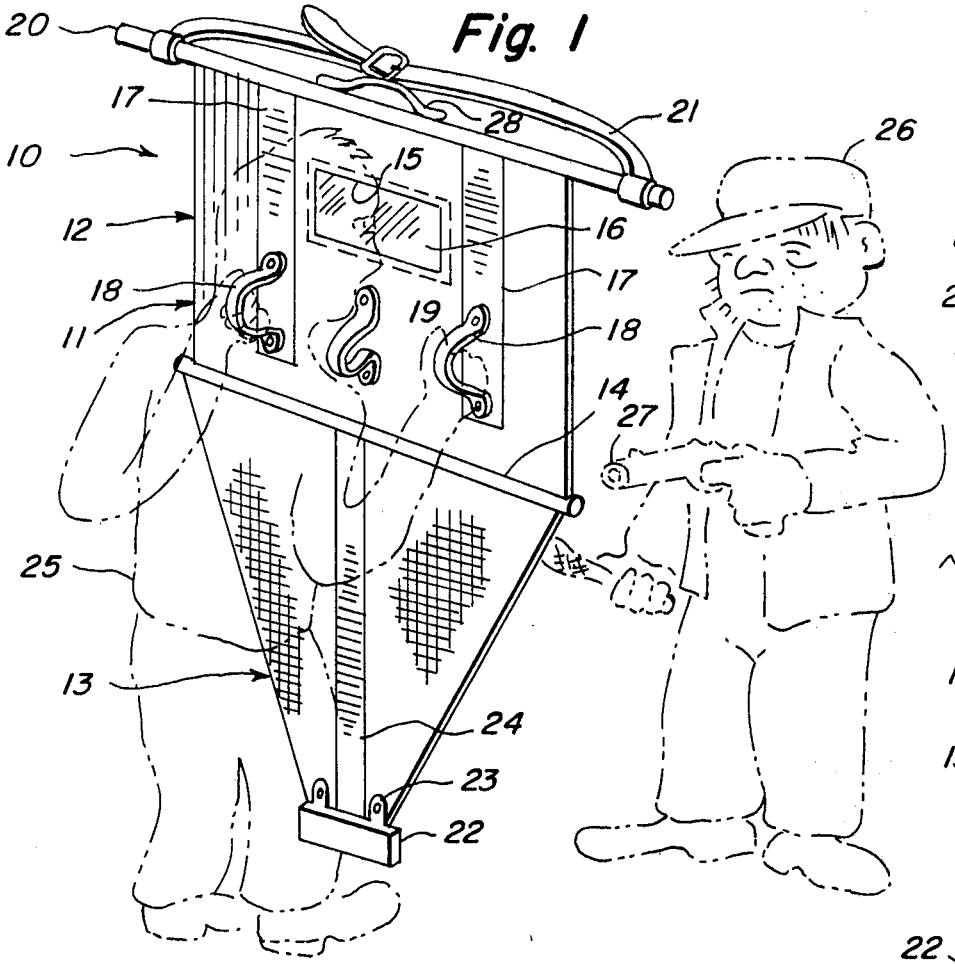
FIG. 1 is a perspective view of one design of the invention shown in use.
Figure 2:
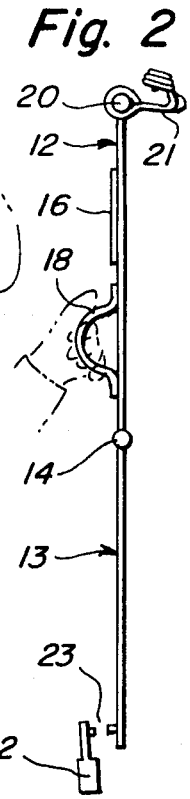
FIG. 2 is a side edge view thereof.

Referring now to the drawing in detail, and more particularly to FIGS. 1 and 2 thereof, at this time, the reference numeral 10 represents a Total Body Protective Shield according to the present invention, wherein there is a flexible fabric panel 11 made of a bullet-proof material such as is used in the construction of bullet-proof vests that are worn by police when in action. The panel includes an upper rectangular panel piece 12 and a lower triangular panel piece 13, each of which along one edge thereof are fastened to a straight stick 14 placed therebetween.

A window opening 15 made in a center of the rectangular panel piece is covered by a bullet-proof, transparent, window pane 16.

Two parallel strips 17 of flexible spring steel are secured to one side of the rectangular panel piece and each strip has a flexible handle 18 secured thereto. A third flexible handle 19 located between the two handles 18, is mounted directly on the panel piece.

Another straight stick 20 is mounted on an opposite edge of the panel piece 12, and an adjustable strap 21 with a buckle is secured at each of its ends to the ends of the stick 20.

A weight 22 is removably secured to an apex of the triangular panel piece by means of snap fasteners 23. A strip 24 of flexible spring steel extending from a center of the stick 14 to the apex of the triangular panel piece, is attached to one side of the triangular panel piece.

In use, if a person 25 is confronted by a thug 26 holding a gun 27, the person grasps the handles 18. The spring steel strips unroll the shield into a flat, straight position, as shown in FIG. 1, so that the shield extends the full height in front of the person, protecting him. The weight holds the apex in a downward position.

A carrying handle 28 permits a person to carry the device when not in use.

Figure 3:
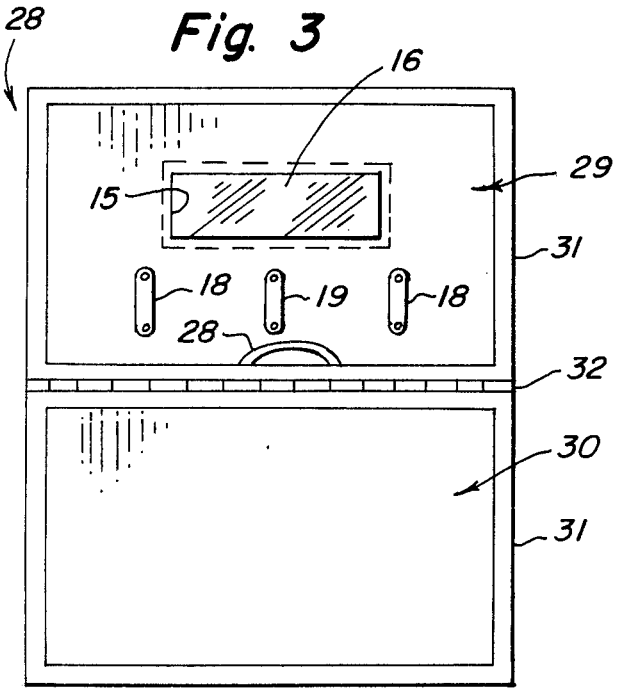
FIG. 3 is a front view of a modified design thereof.
Figure 4:
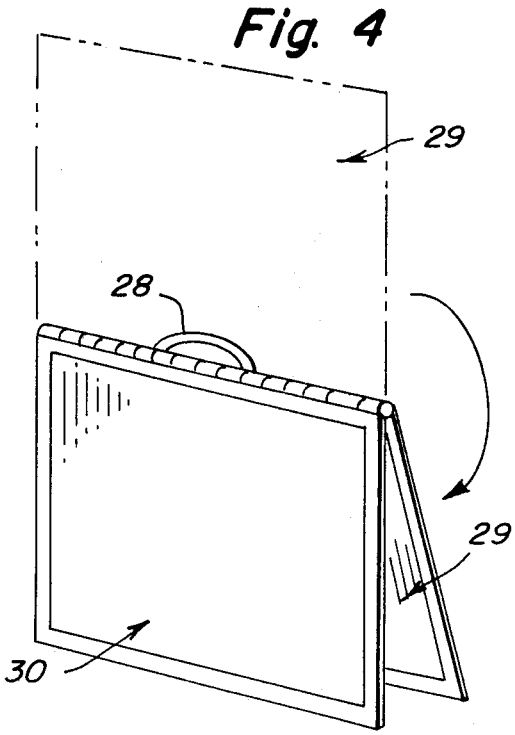
FIG. 4 is a perspective view of the modified design shown with top panel folded down.

In a modified design of the Total Body Protective Shield 28, shown in FIGS. 3 and 4, a rectangular upper panel piece 29 and a lower panel piece 30 are each made of bullet-proof, flexible material, and each panel piece is framed in a rigid framework 31 which are pivotally attached together by means of a hinge 32 therebetween.

The above-described window opening 15 and window pane 16 are included on the upper panel piece. Also the above-described three handles 18 and 19 are mounted directly on the upper panel piece.

The shield 28 differs from shield 10 by being foldable over instead of being rollable up.

While certain novel features of this invention have been shown and described and are pointed out in the annexed claims, it will be understood that various omissions, substitutions and changes in the forms and details of the device illustrated and in its operation can be made by those skilled in the art and with out departing from the spirit of the invention.

I claim:

1. A total body protective device, comprising, in combination, a pair of flexible panel pieces made of bullet-proof fabric for serving as a shield in front of a person, one said panel piece comprising an upper panel piece while the other comprises a lower panel piece assembled together; an upper rod mounted at the top edge of said upper panel piece and a center rod mounted between said upper and said lower panel pieces; an upper of said panel pieces including a plurality of three handles on one side thereof for holding said device vertically and also including a central window of bullet-proof material so as to observe therethrough; both said panel pieces including elongated flexible spring steel strips secured onto one side thereof so as to permit rolling up said panel piece when not in use and quickly unrolling of said panel pieces for instant use and retain said panel pieces flat when use requires such; two of said strips being secured onto said upper panel piece spaced apart and parallel to each other, both extending from said upper rod and terminating spaced from said middle rod, said lower panel piece having a single of said strips secured thereto and extending from said center rod to the lower edge of said lower panel, two of said handles being respectively secured onto said two strips, said strips together with said rods forming a rigid frame for said panel pieces when unrolled, and a lower of said panel piece has a detachable weight snap fastened to a lower edge thereof and coupled to the strip terminating at that edge.

* * * * *